US009227761B2

(12) United States Patent
Knaack

(10) Patent No.: US 9,227,761 B2
(45) Date of Patent: Jan. 5, 2016

(54) BOTTLE PROTECTION DEVICE

(76) Inventor: Jesse A. Knaack, Glenville, MI (US)

( * ) Notice: Subject to any disclaimer, the term of this patent is extended or adjusted under 35 U.S.C. 154(b) by 22 days.

(21) Appl. No.: 12/288,819

(22) Filed: Oct. 23, 2008

(65) Prior Publication Data

US 2009/0107947 A1 Apr. 30, 2009

Related U.S. Application Data

(60) Provisional application No. 60/982,910, filed on Oct. 26, 2007.

(51) Int. Cl.
*B65D 23/08* (2006.01)

(52) U.S. Cl.
CPC ..... *B65D 23/0885* (2013.01)

(58) Field of Classification Search
CPC ..... B65D 23/0885
USPC ..... 215/11.6, 12.1, 13.1, DIG. 3; 220/737, 220/592.12; 150/901; 206/828, 833; 53/449
See application file for complete search history.

(56) References Cited

U.S. PATENT DOCUMENTS

| | | | | | |
|---|---|---|---|---|---|
| 1,428,758 | A | * | 9/1922 | Cowles | 215/11.6 |
| 1,462,291 | A | * | 7/1923 | McCrink | 215/11.6 |
| 1,690,509 | A | * | 11/1928 | Thoreson et al. | 215/11.6 |
| 1,890,323 | A | * | 12/1932 | Glaeser | 215/12.1 |
| 2,729,259 | A | * | 1/1956 | Abrams | 215/12.1 |
| 2,741,386 | A | * | 4/1956 | Williams | 215/12.1 |
| 2,759,617 | A | * | 8/1956 | Gauthier | 215/12.1 |
| 3,309,893 | A | * | 3/1967 | Heffler et al. | 62/372 |
| 3,403,714 | A | * | 10/1968 | Hulm | 221/260 |
| 3,604,584 | A | | 9/1971 | Shank, Jr. | |
| 3,613,761 | A | * | 10/1971 | Moody | 215/11.6 |
| 3,738,529 | A | * | 6/1973 | Rose | 220/739 |
| 3,967,993 | A | * | 7/1976 | Isomi | 156/86 |
| 4,074,824 | A | * | 2/1978 | Kontes | 215/365 |
| 4,197,890 | A | * | 4/1980 | Simko | 383/97 |
| 4,456,138 | A | * | 6/1984 | Bereziat | 215/232 |
| 4,746,017 | A | * | 5/1988 | Howard et al. | 206/438 |
| 5,129,566 | A | * | 7/1992 | Ogden et al. | 225/93 |
| 5,328,069 | A | * | 7/1994 | Cohanfard | 224/148.2 |
| 5,332,399 | A | * | 7/1994 | Grabenkort et al. | 604/415 |
| 5,695,090 | A | | 12/1997 | Burdick | |
| 5,803,284 | A | * | 9/1998 | Grimard | 215/249 |
| 5,904,267 | A | * | 5/1999 | Thompson | 220/592.16 |
| 6,113,008 | A | * | 9/2000 | Arsenault et al. | 239/337 |
| 6,296,129 | B1 | * | 10/2001 | Kawasaki | 215/12.1 |
| 6,604,649 | B1 | * | 8/2003 | Campi | 220/739 |
| 6,772,891 | B1 | * | 8/2004 | Song | 215/11.6 |
| 6,793,076 | B1 | | 9/2004 | Luo et al. | |
| 6,866,159 | B2 | * | 3/2005 | Yamane | 215/400 |
| 7,111,753 | B2 | * | 9/2006 | Scheetz et al. | 215/12.1 |
| 7,225,598 | B2 | * | 6/2007 | Paoletti | 53/397 |
| 8,297,469 | B1 | * | 10/2012 | Alford et al. | 220/737 |
| 2002/0029022 | A1 | * | 3/2002 | Naritomi et al. | 604/256 |
| 2006/0081640 | A1 | * | 4/2006 | Tobias | 220/737 |

(Continued)

FOREIGN PATENT DOCUMENTS

| | | | | |
|---|---|---|---|---|
| DE | 10029711 | A1 | * | 4/2001 |
| DE | 202005018450 | U1 | * | 9/2006 |
| GB | 2240332 | A | * | 7/1991 |

*Primary Examiner* — Sue A Weaver
(74) *Attorney, Agent, or Firm* — James Ray & Assoc

(57) ABSTRACT

A protective device for at least partially encasing a bottle includes an elastomeric sleeve type member for receiving at least a first predetermined portion of such bottle, such sleeve type member having a first predetermined size and a first predetermined shape.

17 Claims, 2 Drawing Sheets

(56) References Cited

U.S. PATENT DOCUMENTS

2007/0017924 A1* 1/2007 Hundley ..... 220/737
2007/0028519 A1* 2/2007 Seibel et al. ..... 47/72
2007/0221693 A1* 9/2007 Moore ..... 224/148.6
2007/0241117 A1* 10/2007 Szymanski ..... 220/737
2008/0179339 A1* 7/2008 Lafaver ..... 220/694
2009/0057257 A1* 3/2009 Marcus et al. ..... 215/11.6

* cited by examiner

BOTTLE PROTECTION DEVICE

CROSS REFERENCE TO RELATED APPLICATION

This patent application is related to and claims priority from U.S. Provisional Patent Application Ser. No. 60/982,910 filed Oct. 26, 2007.

FIELD OF THE INVENTION

The present invention relates, in general, to protective coverings and, more particularly, this invention relates to protective coverings for bottles and the like.

BACKGROUND OF THE INVENTION

Prior to the conception and development of the present invention, bottles, as are generally well known in the prior art, have been used to contain various items. In particular, bottles have long been used to store medicines and chemical. Often, such bottles slip from the grasp of those attempting to handle such bottles and fall and break resulting in spillage of valuable and expensive contents which then become contaminated and unusable. Such spillage may also result in harmful fumes being released into the air, stains to flooring and clothing spattered by such spillage, and in general an unpleasant mess.

Specifically of interest to the present invention are the following: Luo, et al, U.S. Pat. No. 6,793,076, discloses a glass bottle protective enclosure. The enclosure has a leakproof seal and includes a lower bottle container having a base and a plurality of shock absorbing protrusions, on the base is located at least one sensor cavity into which is inserted an enclosure leakage sensor consisting of either a water soluble sensor or an electronic sensor to provide an indication if a bottle leakage occurs.

Burdick, U.S. Pat. No. 5,695,090, discloses a removable insulating container which grips a bottle. The container uses a separate lower sleeve and an upper cap which are mounted on a medicine bottle to substantially encase the medicine bottle. The container is fabricated from a multi-layer flexible material.

Howard, et al, U.S. Pat. No. 4,746,017, discloses a protective safety container for encasing toxic drug filled glass vials. The container includes a molded plastic body that is shaped to conform to the shape of a vial to be protected. A plurality of spaced longitudinal ribs are formed on the inner surface of the container body that act to engage the vial and hold it in position and also form a cushioning air space between the vial and the container. A molded plastic annular base is adapted to be snap fitted into the body such that the vial cannot be easily removed once it is secured within the container.

Shank, U.S. Pat. No. 3,604,584, discloses a protective sheath for encasing sidewall and bottomwall portions of a glass article, such protective sheath being formed from a heat shrinkable material.

SUMMARY OF THE INVENTION

The present invention provides a protective device for at least partially encasing a bottle. Such protective device includes an elastomeric sleeve type member for receiving at least a first predetermined portion of such bottle, such sleeve type member having a first predetermined size and a first predetermined shape.

According to another embodiment, a method for protecting a bottle is provided. Such method includes the steps of providing a protective device for at least partially encasing a bottle, such protective device including an elastomeric sleeve type member for receiving at least a first predetermined portion of such bottle, such elastomeric sleeve type member having a first predetermined size and a first predetermined shape, and placing such bottle within such elastomeric sleeve type member.

OBJECTS OF THE INVENTION

It is, therefore, one of the primary objects of the present invention to provide a simple device which can be fitted onto a bottle to protect such bottle from damage should such bottle sustain an impact.

Another object of the present invention is to provide a reusable bottle covering device which can be used to cover predetermined portions of a bottle such that such bottle will be protected from cracking, breaking, chipping, and the like in the event that such bottle is dropped.

Still another object of the present invention is to provide a protective device for at least partially encasing a bottle during transport, storage, and use such that such bottle is protected from damage in the event that such bottle is dropped, bumped, hit, jostled amongst other items, and the like.

Yet another object of the present invention is to provide a sleeve for encasing a bottle, such sleeve being formed such that such sleeve covers such bottle at key locations such as protruding surfaces and the like, such sleeve being made of a stretchy and shock absorbent material and having an opening disposed therethrough such that a user may see at least one of a label disposed on such bottle, the contents of such bottle, and a combination thereof.

An additional object of the present invention is to provide a protective sleeve type device which is capable of sliding over the top of a bottle and engaging the sides and a portion of the bottom of such bottle such that if the bottle sustains an impact, the shock of the impact will be absorbed by such protective sleeve type device thereby preventing the bottle from being damaged.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
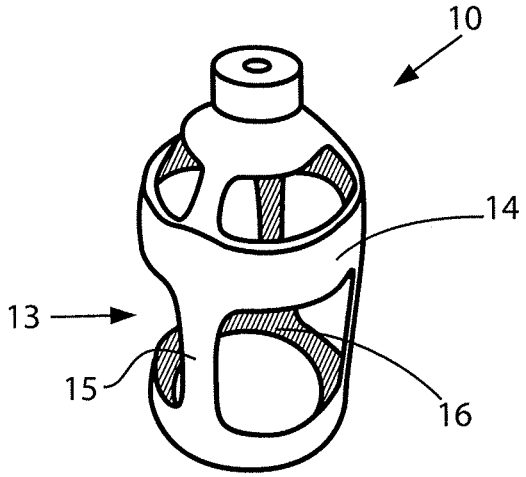
FIG. 1 is a partial perspective view of the invention according to one embodiment of the invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
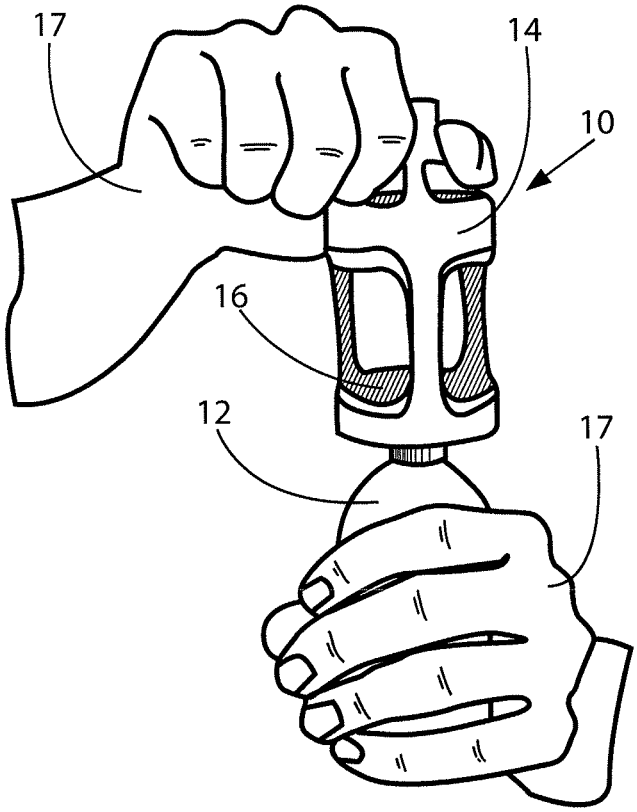
FIG. 2 is a partial perspective view of the invention according to one embodiment of the invention and illustrates how a user would place such invention on a bottle.
Figure 3:
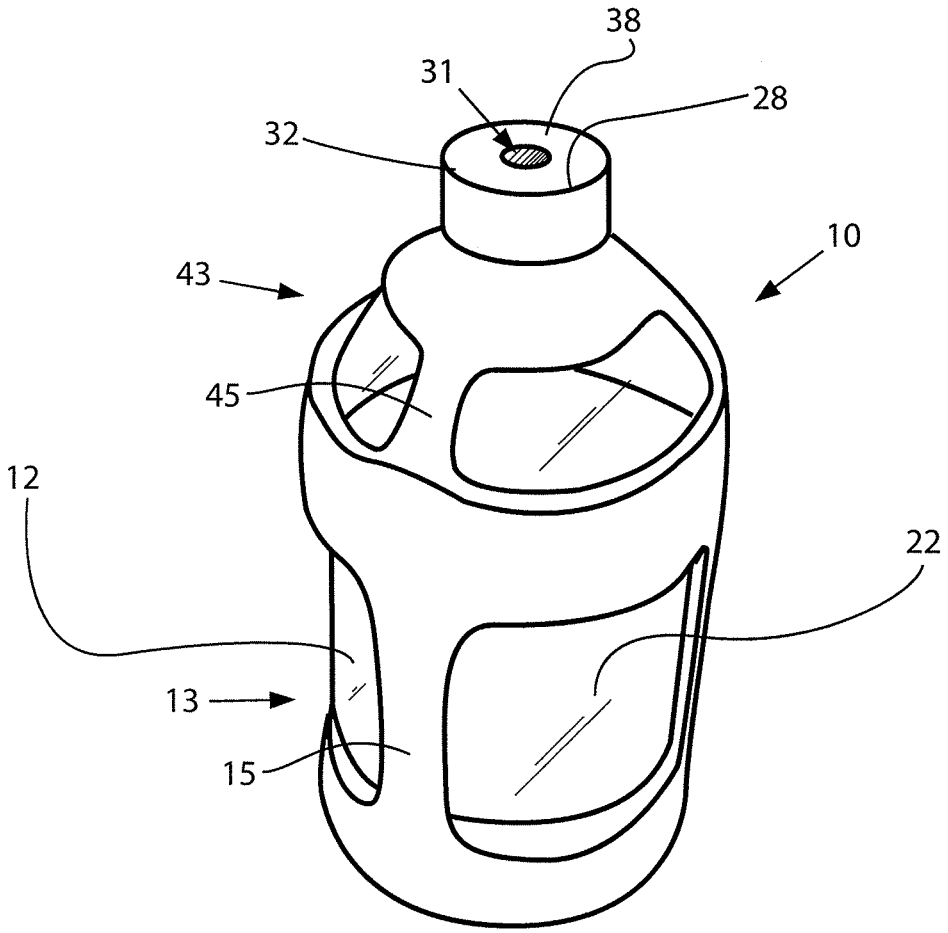
FIG. 3 is a partial perspective view of the invention according to one embodiment of the invention in which the protective device has been implemented on a bottle.

Reference is now made, more particularly, to FIGS. 1-3.

A protective device, generally designated 10, for at least partially encasing a bottle 12 is provided. Such protective device 10 includes an elastomeric sleeve type member 14 for receiving at least a first predetermined portion of such bottle 12, such elastomeric sleeve type member 14 having a first predetermined size and a first predetermined shape.

It is presently preferred that such elastomeric sleeve type member 14 is at least one of rubber, plastic, fabric, foam, cellulose, and a combination thereof. It is presently preferred that such elastomeric sleeve type member 14 is rubber.

It is presently preferred that such elastomeric sleeve type member 14 elastically grips such bottle 12 such that such elastomeric sleeve type member 14 is secured to such bottle 12.

It is presently preferred that such elastomeric sleeve type member 14 further includes a lining 16 operably disposed on an inside portion of such elastomeric sleeve type member 14 and connected thereto at a predetermined location thereon. Such lining 16 is manufactured from a second predetermined material and has a second predetermined size and a predetermined thickness.

It is presently preferred that such first predetermined size and such second predetermined size are substantially identical.

It is further presently preferred that such second predetermined material is at least one of fabric, cellulose, foam, padding, and a combination thereof. It is presently preferred that such second predetermined material is an elastomer. It is presently preferred that such elastomer is a polyurethane copolymer derivative of polytetramethylene ether glycol (PTMEG), commonly known as Lycra®.

It is presently preferred that such elastomeric sleeve type member 14 includes at least one aperture disposed therethrough such that at least one of at least a second predetermined portion of such bottle 12, a label 22 disposed on such bottle 12, contents (not shown) of such bottle 12, and a combination thereof is visible through such at least one aperture. According to another embodiment such elastomeric sleeve type member 14 includes a plurality of apertures disposed therethrough at a plurality of predetermined locations thereon such that at least one of at least a third predetermined portion of such bottle 12, a label 22 disposed on such bottle 12, contents (not shown) of such bottle 12, and a combination thereof are visible through such plurality of apertures. As illustrated in FIGS. 1 and 3, a plurality of spaced apart apertures 13 disposed through such device 10 permit various portions of such bottle 12 to be visible when the device 10 has been placed on such bottle 12. As further illustrated in FIG. 1, the plurality of spaced-apart apertures 13 is typically three windows defining elongated thickness portions 15 separating them.

As shown in FIGS. 1, 2, and 3, it is presently preferred that such elastomeric sleeve type member 14 is open-bottom, and includes a cap covering portion 28 said sleeve type member 14 opposite said bottom end for covering at least one of a cap of such bottle, a lid of such bottle, a foil covered top of such bottle, and a combination thereof. Such cap of such bottle, such lid of such bottle, and such foil covered top of such bottle being generally designated 31. In further reference to the Figures, the sleeve member 14 has a plurality of upper-portion apertures 43 formed through the thickness of sleeve member 14 adjacent the cap covering portion 28. It is presently preferred to include at least two upper-portion apertures 43. A pair of adjacent apertures 43 is separated from each other by an elongated thickness portion 45. As is best shown in FIG. 3, there is also a plurality of lower-portion window-like apertures 13 such that a pair of adjacent apertures 13 is separated from each other by an elongated thickness portion 15. Furthermore, the apertures 43 are separated in the axial direction from apertures 13 by a thickness region that spans circumference of the protective device 10.

It is presently preferred that such cap covering portion 28 includes an aperture disposed through a top portion 38 thereof for providing access to at least one of such cap of such bottle, such lid of such bottle, such foil covered top of such bottle, and such combination thereof. Thus an embodiment is provided which is particularly useful for protecting bottles having contents which are extracted from such bottle through use of a needle inserted through the bottle cap or covering since this particular embodiment of the device will not interfere with such an extraction.

According to one embodiment, it is meant that a user 17, be able to insert such bottle 12 into the protective device 10 as illustrated in FIG. 2, however, the device is not meant to be limited as such and such device may be placed and such bottle or such bottle may be placed within such device in any manner which reasonably facilitates such device's purpose.

According to another embodiment, a method for protecting a bottle is provided. Such method includes the steps of providing a protective device for at least partially encasing a bottle, such protective device including an elastomeric sleeve type member for receiving at least a first predetermined portion of such bottle, such elastomeric sleeve type member having a first predetermined size and a first predetermined shape, and placing such bottle within such elastomeric sleeve type member.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A protective device for at least partially encasing a bottle comprising:

an elastomeric open-bottom sleeve type member for receiving at least a portion of the bottle, said elastomeric open-bottom sleeve type member having a lower portion, an upper portion tapered inwardly relative to said lower portion and a plurality of spaced-apart apertures formed through a thickness of said elastomeric open-bottom sleeve type member and defining elongated thickness portions separating a pair of adjacently disposed apertures; and a cap covering portion disposed at an outer end of said upper portion of said elastomeric open-bottom sleeve type member, opposite said open bottom thereof, said cap covering portion shaped to partially uncover a terminal end surface of at least one of a cap of the bottle, a lid of the bottle, a foil covered top of the bottle, and a combination thereof.

2. A protective device according to claim 1 wherein said elastomeric open-bottom sleeve type member is at least one of rubber, plastic, fabric, foam, cellulose, and a combination thereof.

3. A protective device according to claim 2 wherein said elastomeric open-bottom sleeve type member is rubber.

4. A protective device according to claim 1 wherein said elastomeric open-bottom sleeve type member elastically grips the bottle such that said elastomeric open-bottom sleeve type member is secured to the bottle.

5. A protective device according to claim 1 further including a lining operably disposed on an inside portion of said elastomeric open-bottom sleeve type member and connected thereto at a predetermined location thereon.

6. A protective device according to claim 5 wherein said lining is manufactured from a material being at least one of fabric, cellulose, foam, padding, and a combination thereof.

7. A protective device according to claim 5 wherein said lining is manufactured from an elastomeric material.

8. A protective device according to claim 7 wherein said elastomer is polyurethane copolymer of PTMEG.

9. A protective device according to claim 1 wherein said plurality of apertures includes at least two spaced-apart apertures formed through a thickness of said upper portion of said elastomeric open-bottom sleeve type member and three spaced-apart apertures formed through a thickness of said lower portion, said apertures defining elongated thickness portions separating adjacently disposed apertures such that at least one of at least a portion of the bottle, a label disposed on the bottle, contents of the bottle, and a combination thereof are visible through said spaced-apart apertures.

10. A protective device according to claim 1 wherein said cap covering portion includes an aperture disposed through a top portion thereof for providing access to the terminal end surface of at least one of the cap of the bottle, the lid of the bottle, the foil covered top of the bottle, and such combination thereof.

11. The protective device of claim 1, wherein said elastomeric open-bottom sleeve type member further comprises a continuous inturned flange covering a portion of a terminal bottom end surface of the bottle received within said elastomeric open-bottom sleeve type member.

12. The protective device of claim 1, wherein said cap covering portion has a cylindrical shape with a continuous exterior surface, a proximal end thereof attached to said outer end of said upper portion of said elastomeric open- bottom sleeve member and further having an aperture formed through a distal end of said cap covering portion so as to partially uncover the terminal end surface.

13. The protective device according to claim 1 wherein said plurality of apertures includes three spaced-apart apertures formed through a thickness of said upper portion of said elastomeric open-bottom sleeve type member and three spaced-apart apertures formed through a thickness of said lower portion, said apertures defining elongated thickness portions separating adjacently disposed apertures such that at least one of at least a portion of the bottle, a label disposed on the bottle, contents of the bottle, and a combination thereof are visible through said spaced-apart apertures.

14. A protective device for at least partially encasing a bottle, consisting of:

an elastomeric open-bottom end sleeve member sized to receive the bottle therethrough and having a continuous inturned flange covering a portion of a terminal bottom end surface of the bottle received within said elastomeric open-bottom end sleeve member, said elastomeric open-bottom end sleeve member having an inwardly tapered surface defining an upper portion thereof;

a plurality of spaced-apart apertures formed through a thickness of a lower portion adjacent said open-bottom end of said elastomeric open-bottom end sleeve member and defining elongated thickness portions separating adjacently disposed apertures;

a cap covering portion having a cylindrical shape with a continuous exterior surface, a proximal end thereof attached to an outer end of said upper portion of said elastomeric open-bottom end sleeve member opposite said open bottom and further having an aperture formed through a distal end of said cap covering portion so as to partially uncover a terminal end surface of at least one of a cap of the bottle, a lid of the bottle, a foil covered top of the bottle, and a combination thereof; and a plurality of spaced-apart apertures formed through a thickness of said upper portion of said elastomeric open-bottom end sleeve member adjacent said cap covering portion and defining elongated thickness portions separating adjacently disposed apertures formed through said thickness of said upper portion.

15. The protective device according to claim 14, wherein said plurality of upper portion spaced-apart apertures is generally aligned in an axial direction of said protective device with a respective one of said plurality of lower portion spaced-apart apertures and is separated in said axial direction of said protective device by a thickness region, said thickness region spanning circumference of said elastomeric open-bottom end sleeve member.

16. A method for protecting a bottle, said method comprising the steps of:

a. providing a protective device for at least partially encasing a bottle, such protective device including an open-bottom elastomeric sleeve type member for receiving at least a portion of said bottle, and a cap covering portion including an aperture formed therethrough so as to partially uncover a terminal end surface of at least one of a cap of the bottle, a lid of the bottle, a foil covered top of the bottle, and a combination thereof, said protective device having a plurality of spaced apart apertures formed through a thickness of said elastomeric sleeve type member, said plurality of spaced apart apertures defining elongated thickness portions separating a pair of adjacently disposed apertures;

b. placing the bottle within said elastomeric sleeve type member through said open bottom;

c. sliding a cap portion of the bottle into said cap covering portion of said protective device; and d. partially uncovering the terminal end surface of the at least one of the cap of the bottle, the lid of the bottle, the foil covered top of the bottle, and the combination thereof.

17. The method of claim 16, further comprising the step of providing access to the at least one of the cap of the bottle, the lid of the bottle, the foil covered top of the bottle, and the combination thereof.

* * * * *